US010001733B2

(12) United States Patent
Zhang et al.

(10) Patent No.: US 10,001,733 B2
(45) Date of Patent: Jun. 19, 2018

(54) FIXING DEVICE PROVIDED WITH BELT GUIDE, AND METHOD OF MANUFACTURING THE SAME

(71) Applicant: Brother Kogyo Kabushiki Kaisha, Nagoya-shi, Aichi-ken (JP)

(72) Inventors: Mingguang Zhang, Nagoya (JP); Takuji Matsuno, Ichinomiya (JP); Kei Ishida, Inuyama (JP); Kotaro Fujishiro, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/367,479

(22) Filed: Dec. 2, 2016

(65) Prior Publication Data

US 2017/0160684 A1 Jun. 8, 2017

(30) Foreign Application Priority Data

Dec. 4, 2015 (JP) ..... 2015-237397

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2085; G03G 15/2053; G03G 15/2035; G03G 15/2064; G03G 15/2028; G03G 15/2025; G03G 15/2042; G03G 15/206
See application file for complete search history.

(56) References Cited

U.S. PATENT DOCUMENTS 5,280,155 A 1/1994 Ohtsuka et al.
7,235,761 B1 * 6/2007 Maul ..... G03G 15/2064 219/216
8,929,791 B2 * 1/2015 Ishii ..... G03G 15/206 399/320
8,942,611 B2 * 1/2015 Sato ..... G03G 15/2085 399/107
2008/0187372 A1 * 8/2008 Kato ..... G03G 15/6591 399/328

(Continued)

FOREIGN PATENT DOCUMENTS

JP H05-027625 A 2/1993
JP H10-284218 A 10/1998

(Continued)

*Primary Examiner* — Clayton E Laballe
*Assistant Examiner* — Ruifeng Pu
(74) *Attorney, Agent, or Firm* — Banner & Witcoff, Ltd.

(57) ABSTRACT

A fixing device includes a belt, and a belt guide configured to guide movement of the belt. The belt guide includes a base part and a first protrusion protruding from a surface of the base part toward a surface of the belt. The first protrusion has a distal end surface and a side surface, the surface of the belt being configured to contact the distal end surface, the distal end surface having a distal surface roughness, the side surface connecting the distal end surface and the surface of the base part. At least one of the side surface and the surface of the base part includes a rough region having a surface roughness higher than the distal surface roughness.

22 Claims, 11 Drawing Sheets

(56) References Cited

U.S. PATENT DOCUMENTS

| | | | | |
|---|---|---|---|---|
| 2011/0236086 | A1* | 9/2011 | Suzuki | G03G 15/2064 399/329 |
| 2013/0251422 | A1* | 9/2013 | Iwaya | G03G 15/2053 399/329 |
| 2013/0315637 | A1 | 11/2013 | Sato et al. | |
| 2014/0186079 | A1* | 7/2014 | Morita | G03G 15/2053 399/329 |
| 2015/0093167 | A1* | 4/2015 | Hazeyama | G03G 15/2053 399/329 |
| 2015/0125193 | A1* | 5/2015 | Ishii | G03G 15/2042 399/329 |
| 2016/0231675 | A1* | 8/2016 | Ishida | G03G 15/2053 |
| 2016/0231676 | A1* | 8/2016 | Ishida | G03G 15/2053 |
| 2016/0231677 | A1* | 8/2016 | Ishida | G03G 15/2053 |
| 2017/0102652 | A1* | 4/2017 | Imada | G03G 15/2053 |
| 2017/0227900 | A1* | 8/2017 | Ishida | G03G 15/2053 |
| 2017/0248881 | A1* | 8/2017 | Suzuki | G03G 15/2028 |
| 2017/0343940 | A1* | 11/2017 | Suzuki | G03G 15/2085 |

FOREIGN PATENT DOCUMENTS

| | | | |
|---|---|---|---|
| JP | 2005-010201 | A | 1/2005 |
| JP | 2013-242486 | A | 12/2013 |

* cited by examiner

FIG. 7

Ra VALUES INDICATIVE OF
SURFACE ROUGHNESS OF RESPECTIVE REGIONS

| | RA | RB | RC | RD |
|---|---|---|---|---|
| HIGH | 0.4<br>(0.4 ~ 1.0) | 2.5<br>(2.5 ~ 2.9) | 1.5<br>(1.5 ~ 1.9) | 2.5<br>(2.5 ~ 2.9) |
| LOW | 0.4<br>(0.4 ~ 1.0) | 3.0<br>(3.0 ~ 3.5) | 2.0<br>(2.0 ~ 2.4) | 3.0<br>(3.0 ~ 3.5) |

UNIT: μm

FIXING DEVICE PROVIDED WITH BELT GUIDE, AND METHOD OF MANUFACTURING THE SAME

CROSS REFERENCE TO RELATED APPLICATION

This application claims priority from Japanese Patent Application No. 2015-237397 filed Dec. 4, 2015. The entire content of the priority application is incorporated herein by reference.

TECHNICAL FIELD

The present disclosure relates to a fixing device.

BACKGROUND

There is known a fixing device provided in an image-forming apparatus such as a printer and a copying machine for thermally fixing a toner image to a sheet by heating the sheet. Such a fixing device employs a belt and a guide member in contact with an inner peripheral surface of the belt for guiding movement of the belt.

Japanese Patent Application Publication No. H05-027625 discloses such type of fixing device that is provided with a guide member having protrusions protruding from an outer surface of the guide member toward the surface of the belt for reducing sliding resistance between the belt and the guide member.

SUMMARY

In the above-described fixing device in which the protrusions are formed on the outer surface of the guide member, the belt is configured to move over the guide member with a gap provided between the inner surface of the belt and the outer surface of the guide member where the protrusions do not exist. Therefore, lubricant may be leaked from the gap in accordance with the movement of the belt.

In view of the foregoing, it is one of objects of the present disclosure to provide a fixing device capable of restraining leakage of the lubricant out of the gap between the belt and the guide member, while reducing frictional resistance between the belt and the guide member.

In order to attain the above and other objects, the disclosure provides a fixing device including a belt having a surface, and a belt guide configured to guide movement of the belt. The belt guide includes: a base part having a surface; and a first protrusion protruding from the surface of the base part toward the surface of the belt. The first protrusion has a first distal end surface and a first side surface, the surface of the belt being configured to contact the first distal end surface, the first distal end surface having a first distal surface roughness, the first side surface connecting the first distal end surface and the surface of the base part, at least one of the first side surface and the surface of the base part including a rough region having a surface roughness higher than the first distal surface roughness.

With this structure, since the distal end surface is formed to have a lower surface roughness, frictional resistance between the belt and the distal end face of the first protrusion of the guide member can be reduced.

According to another aspect, there is provided a method of manufacturing a fixing device including a belt, and a belt guide configured to guide movement of the belt. The belt guide includes a base part and a first protrusion protruding from a surface of the base part toward a surface of the belt, the first protrusion having a distal end surface and a side surface, the surface of the belt being configured to contact the distal end surface, the side surface connecting the distal end surface and the surface of the base part, at least one of the side surface and the surface of the base part including a rough region. The method includes: polishing the distal end surface by a polishing member having a polishing surface such that the distal end surface has a surface roughness lower than a surface roughness of the rough region.

According to still another aspect, there is provided a method of manufacturing a fixing device including a belt, and a belt guide configured to guide movement of the belt. The belt guide includes a base part and a first protrusion protruding from a surface of the base part toward a surface of the belt, the first protrusion having a distal end surface and a side surface, the surface of the belt being configured to contact the distal end surface, the side surface connecting the distal end surface and the surface of the base part. The method includes: molding the distal end surface of the first protrusion with a first mold surface formed in a mold; and molding at least one of the side surface of the first protrusion and the surface of the base part with a second mold surface formed in the mold, the second mold surface having a surface roughness higher than a surface roughness of the first mold surface.

BRIEF DESCRIPTION OF THE DRAWINGS

In the drawings:

FIG. 7 is a table showing Ra values indicative of surface roughness of respective regions RA, RB, RC, and RD in an upper region RH and a lower region RL;

DETAILED DESCRIPTION

Hereinafter, a printer 10 provided with a fixing unit 700 as a fixing device according to an embodiment will be described with reference to accompanying drawings.

Figure 1:
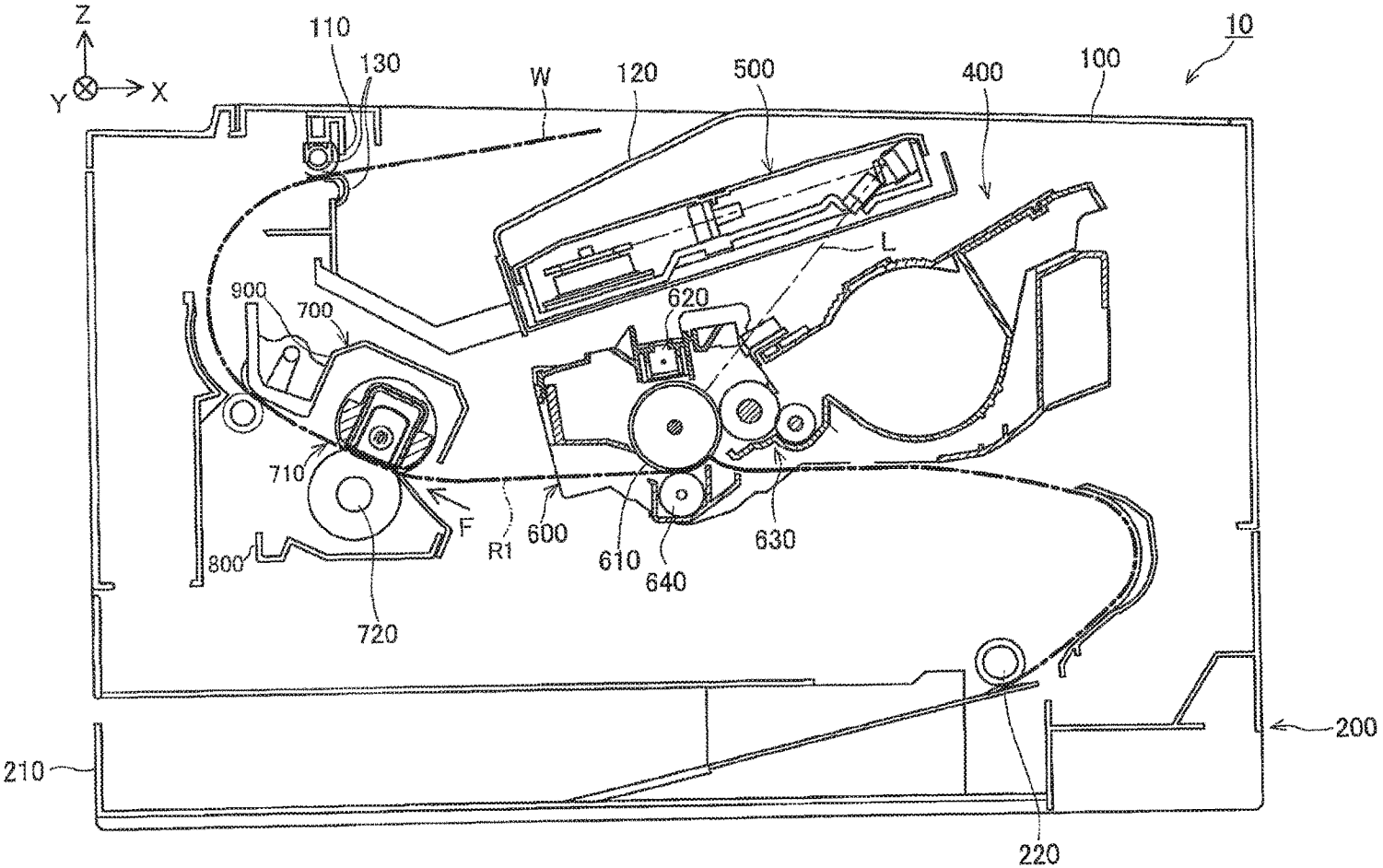
FIG. 1 is a schematic view showing an overall structure of a printer provided with a fixing device according to an embodiment.

In FIG. 1, x-axis, y-axis and z-axis extending perpendicular to each other are shown for specifying directions. The printer 10 is an electro-photographic type monochromatic printer using toner (developer) of a single color such as black for forming an image on a sheet W such as a recording sheet, and OHP sheet.

<Overall Structure of the Printer>

As illustrated in FIG. 1, the printer 10 includes a housing 100, a sheet-supplying unit 200, and an image-forming unit 400. The housing 100 accommodates therein the sheet-supplying unit 200 and the image-forming unit 400. The housing 100 has an upper surface formed with a sheet discharge opening 110 and provided with a sheet discharge tray 120. Discharge rollers 130 are provided in the housing 100 at a position near the sheet discharge opening 110.

The sheet-supplying unit 200 includes a tray 210, and a pick-up roller 220. The tray 210 is adapted to accommodate a stack of sheets W. The pick-up roller 220 is adapted to pick up a single sheet from the stack of sheets W in the tray 210, and to convey each sheet W to the image-forming unit 400.

The image-forming unit 400 includes an exposure unit 500, a process unit 600 including a photosensitive member 610, and the fixing unit 700. The exposure unit 400 is adapted to irradiate a laser beam L (optical beam) to the photosensitive member 610.

The process unit 600 includes the photosensitive member 610, a charger 620, a developing unit 630, and a transfer roller 640. The charger 620 is configured to uniformly charge a surface of the photosensitive member 610. Upon irradiation of the laser beam L from the exposure unit 500 to the surface of the photosensitive member 610 that has been charged by the charger 620, an electrostatic latent image is formed on the surface of the photosensitive member 610. Further, the developing unit 630 is adapted to supply toner to the surface of the photosensitive member 610. Toner image corresponding to the electrostatic latent image is thus formed on the surface of the photosensitive member 610 upon toner supply. The toner image formed on the surface of the photosensitive member 610 is transferred onto the sheet W by the transfer roller 640 when the sheet W passes through a position at which the photosensitive member 610 and the transfer roller 640 oppose each other.

The fixing unit 700 is adapted to heat the sheet W that has moved past the process unit 600 for thermally fixing the toner image to the sheet W. Thus, the visible toner image is fixed to the sheet W. The discharge rollers 130 are configured to discharge the sheet W having moved past the fixing unit 700 onto the sheet discharge tray 120 through the sheet discharge opening 110.

<Structure of the Fixing Device>

A further detail of the fixing unit 700 will be described next.

In the following description, a sheet conveying path from the sheet-supplying unit 200 to the discharge rollers 130 will be referred to as "conveying path R1". Further, a direction in which the sheet W is conveyed to the fixing unit 700 along the conveying path R1 will be referred to as "conveying direction F".

Figure 2:
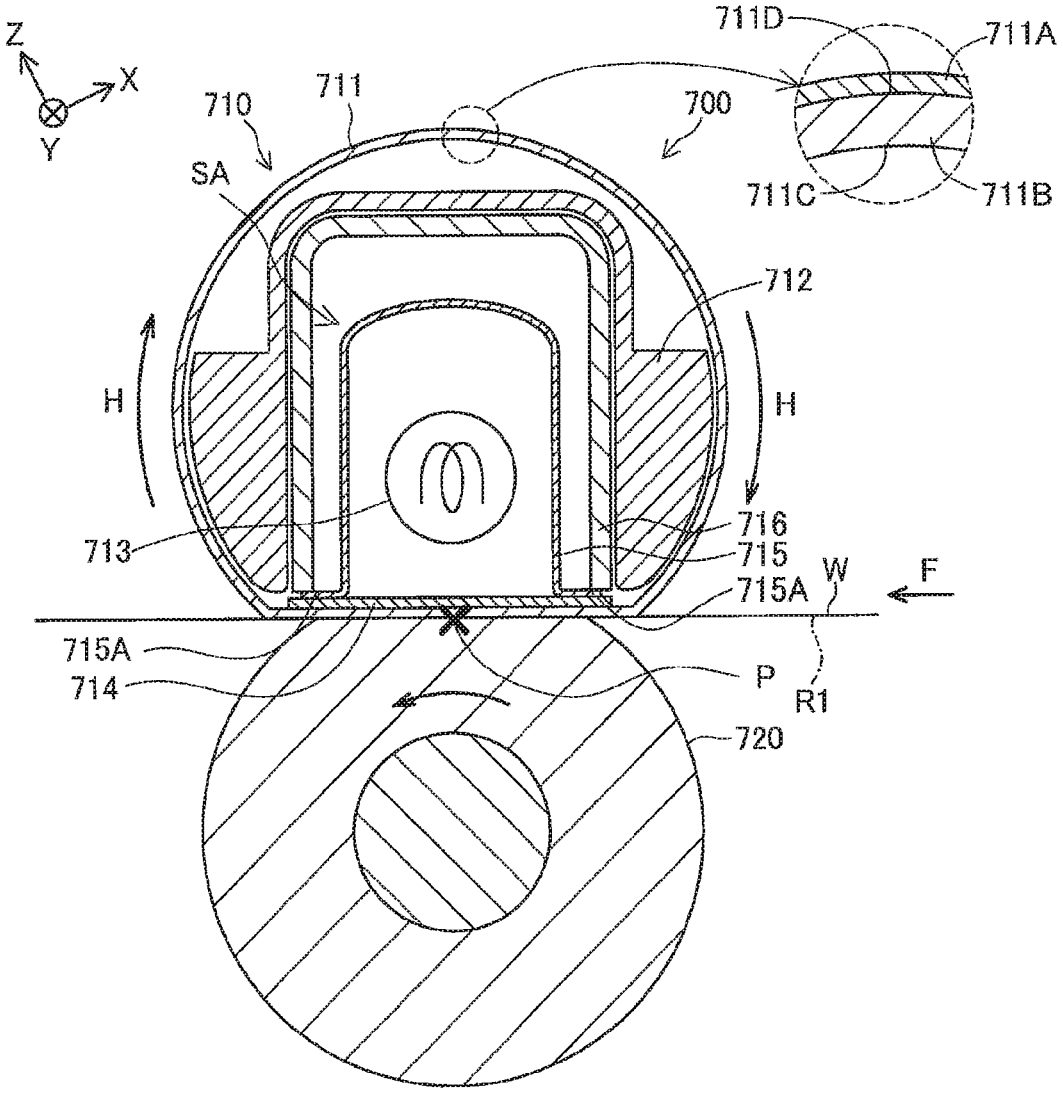
FIG. 2 is a cross-sectional side view of the fixing device according to the embodiment.

The fixing unit 700 is illustrated in FIGS. 1 and 2. The fixing unit 700 includes a heat unit 710, a pressure unit 720, a first cover 800, and a second cover 900. As shown in FIG. 2, the heat unit 710 and the pressure unit 720 are positioned opposite to each other with respect to the conveying path R1. That is, the conveying path R1 is defined between the heat unit 710 and the pressure unit 720.

Specifically, referring to FIG. 2, the heat unit 710 includes a fixing belt 711, a halogen heater 713, a nip member 714, a reflection member 715, a stay 716, and a guide member 712.

The fixing belt 711 is an endless belt of a tubular shape extending in a direction perpendicular to the conveying direction F. The fixing belt 711 is an example of "belt". Hereinafter, this direction in which the fixing belt 711 extends will be referred to as "longitudinal direction" of the fixing belt 711. That is, the longitudinal direction is perpendicular to the conveying direction F and is parallel to the Y-axis in FIG. 2. The endless belt 711 is circularly movable in a direction H perpendicular to the longitudinal direction. The direction H in which the fixing belt 711 is configured to circularly move will be referred to as "moving direction H" of the fixing belt 711, hereinafter. More in detail, as illustrated in FIG. 2, the fixing belt 711 includes a polyimide resin layer 711B as an inner layer, and a fluorine-contained resin layer 711A as an outer layer coated over an outer surface 711D of the polyimide resin layer 711B. The polyimide resin layer 711B has an inner peripheral surface 711C serving as an inner peripheral surface of the fixing belt 711. The inner surface 711C is an example of "peripheral surface" of the belt. The halogen heater 713 is a heater configured to generate heat upon receipt of electric power supplied from an AC source (not shown). The halogen heater 713 is positioned in an internal space defined by the fixing belt 711 and spaced away from the inner peripheral surface 711C of the polyimide resin layer 711B.

The nip member 714 is positioned to be in contact with the inner peripheral surface 711C of the fixing belt 711 along the conveying path R1. That is, the nip member 714 has a surface facing the halogen heater 713, and another surface facing the conveying path R1 and in contact with the inner peripheral surface 711C of the fixing belt 711. The nip member 714 is a plate like member extending in the conveying direction F, and is made from a metal such as aluminum.

The reflection member 715 is positioned in the internal space defined by the fixing belt 711 to face the inner peripheral surface 711C thereof. The reflection member 715 is a plate like member bent into U-shape, in a side view, to cover a major portion of an outer surface of the halogen heater 713. The opening of the "U-shape" of the reflection member 715 faces the nip member 714. The reflection member 715 is made from metal such as aluminum, and is subjected to mirror-like finishing. The reflection member 715 includes a pair of flanged portions 715A.

The stay 716 is positioned to cover the reflection plate 715, and has a profile in conformance with an outer surface of the reflection plate 715. The stay 716 is made from a steel plate. The stay 716 and the nip plate 714 nip the flanged portions 715A therebetween, to restrain displacement of the reflection member 715 in a direction perpendicular to the conveying path R1.

The guide member 712 is positioned between the stay 716 and the fixing belt 711 to face the inner peripheral surface 711C of the fixing belt 711. The guide member 712 is positioned to cover the stay 716. Details of the guide member 712 will be described later.

The pressure unit 720 is positioned opposite to the heat unit 710 with respect to the conveying path R1. More specifically, the pressure unit 720 is disposed to oppose the nip member 714 with the fixing belt 711 nipped therebetween. The pressure unit 720 is a roller rotatable about an axis extending in a direction parallel to the longitudinal direction of the fixing belt 711. The pressure unit 720 is urged toward the nip member 714 to form a nip region P between the fixing belt 711 (resin layer 711A) and the pressure roller 720. The sheet W is configured to be nipped at the nip region P and conveyed in the conveying direction F.

The first cover 800 is adapted to cover the pressure unit 720 and a portion of the heat unit 710 (a lower portion in FIG. 2; at the negative Z-axis side). The first cover 800 rotatably supports the heat unit 710 and the pressure unit 720. The second cover 900 is adapted to cover a portion of the heat unit 710 (an upper portion in FIG. 2; at the positive Z-axis side).

By heat generation at the halogen heater 713, the fixing belt 711 is heated through the nip member 714 so that a temperature of the fixing belt 711 is elevated. Further, by the rotation of the pressure unit 720 by a driving force from a main motor (not shown), the fixing belt 711 is driven to be circularly moved in the moving direction H. The guide member 712 is in contact with the inner peripheral surface 711C of the fixing belt 711 through lubricant 750 (see FIG. 5) so as to guide the circular movement of the fixing belt 711. The sheet W moved past the process unit 600 reaches the nip region P between the fixing belt 711 and the pressure unit 720, and is heated by the fixing belt 711 while being conveyed by the fixing belt 711 and the pressure unit 720.

Hereinafter, a detailed structure of the guide member 712 will be described with reference to FIGS. 3 through 6.

Figure 3:
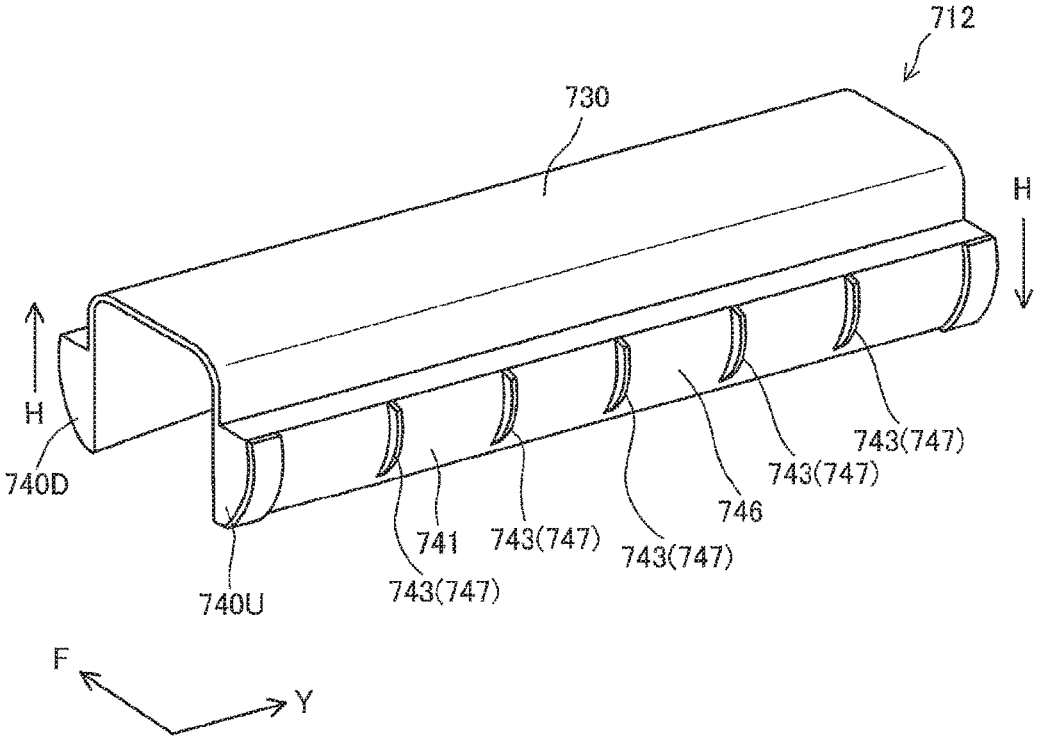
FIG. 3 is a perspective view showing an external appearance of a guide member in the fixing device according to the embodiment.

Referring to FIG. 3, the guide member 712 includes a pair of side walls 740, and a connecting part 730. The side walls 740 are spaced apart from each other in the conveying direction F. Hereinafter, one of the side walls 740 disposed on the upstream side in the conveying direction F will be referred to as "upstream side wall 740U", while the other one of the side walls 740 disposed on the downstream side in the conveying direction F will be referred to "downstream side wall 740D", whenever necessary. Each side wall 740 includes a base part 741, and a plurality of ribs 743. The base part 741 is a plate-shaped part aligned in a direction orthogonal to the conveying direction F. That is, the base part 741 extends parallel to the Y-axis. The base part 741 of the upstream side wall 740U has a thickness in the conveying direction F that decreases toward downstream in the moving direction H (as extending toward the nip member 714). The base part 741 of the downstream side wall 740D has a thickness in the conveying direction F that increases toward downstream in the moving direction H (as extending away from the nip member 714). The base part 741 of each side wall 740 has an outer surface 746 facing the inner surface 711C of the fixing belt 711.

The ribs 743 are formed on the outer surface 746 of the base part 741 constituting each side wall 740. The ribs 743 protrude outward from the outer surface 746 of each base part 741. That is, the ribs 743 protrude from the outer surface 746 of the base part 741 of each side wall 740 toward the inner peripheral surface 711C of the fixing belt 711 (see FIG. 2). Each rib 743 has a distal end (protruding end) configured to contact the inner peripheral surface 711C of the fixing belt 711.

More specifically, the ribs 743 are formed on the outer surface 746 of each base part 741 at regular intervals in the longitudinal direction of the fixing belt 711. Each rib 743 extends in the moving direction H of the fixing belt 711 along the corresponding outer surface 746. Hence, a longitudinal direction of the ribs 743 is substantially aligned with the moving direction H. In the upstream side wall 740U, the amount that the ribs 743 protrude from the outer surface 746 of the base part 741 decreases toward downstream in the moving direction H to conform with the curved shape of the fixing belt 711. Likewise, in the downstream side wall 740D, the amount that the ribs 743 protrude from the outer surface 746 of the base part 741 increases toward downstream in the moving direction H to conform with the curved shape of the fixing belt 711. Each rib 743 has an outer surface 747.

The connecting part 730 is a plate-shaped part that connects the both side walls 740. The connecting part 730 is disposed opposite to the conveying path R1 with respect to the side walls 740.

Figure 4:
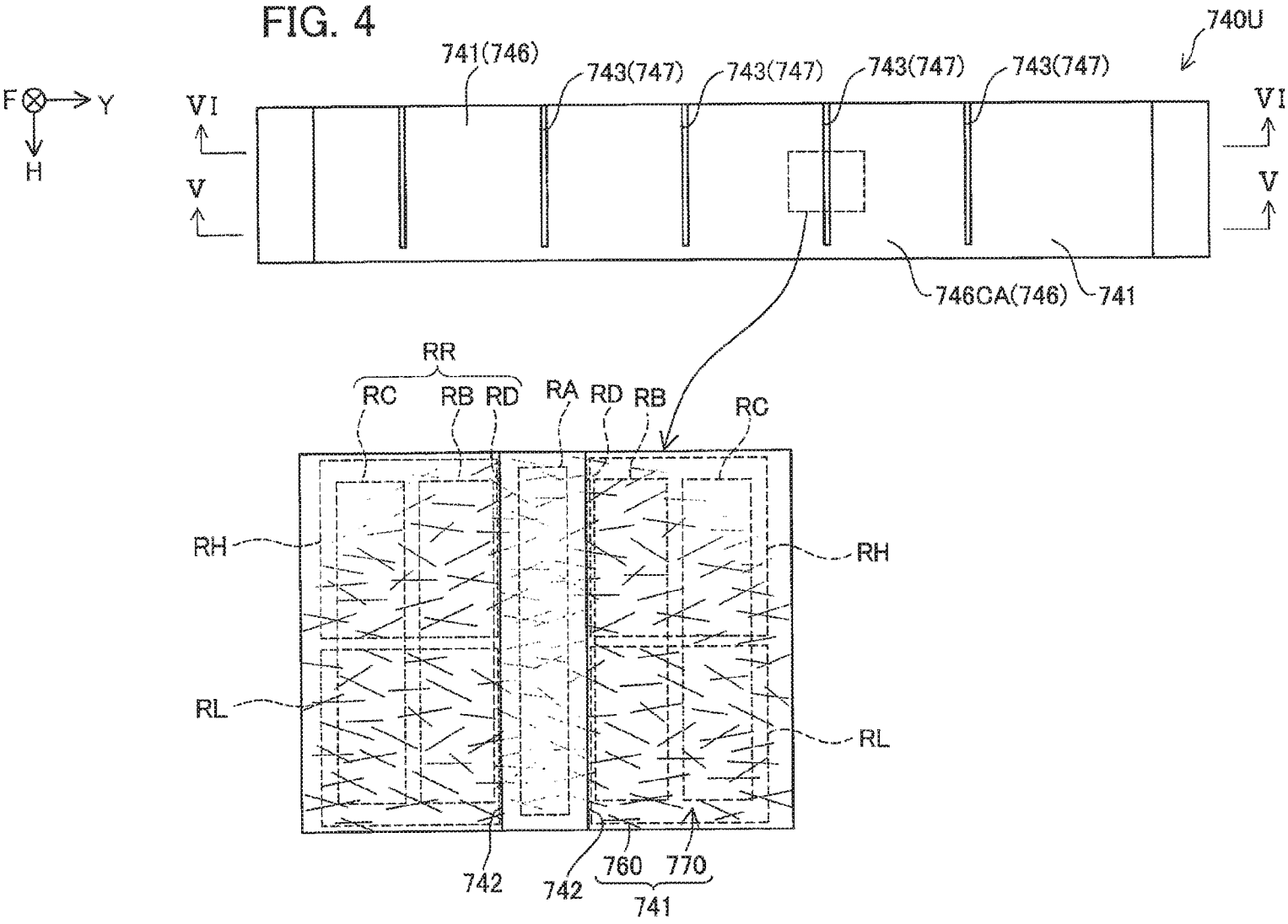
FIG. 4 is a front view of a side wall (upstream side wall) constituting the guide member.

Referring to FIG. 4, the guide member 712 is made from a liquid-crystal polymer 770, and glass fibers 760 mixed in the liquid-crystal polymer 770. The glass fibers 760 are dispersed in the liquid-crystal polymer 770 such that the glass fibers 760 are raised from the liquid-crystal polymer 770 on the outer surface 746 of each base part 741 and on the surfaces 747 of the ribs 743. As shown in an enlarged view of FIG. 4, the glass fibers 760 extend in directions crossing the moving direction H of the fixing belt 711. The liquid-crystal polymer 770 is an example of "resin" and the glass fibers 760 are an example of "fillers".

In the following description, referring to FIG. 4, a region on the surface 747 of each rib 743 that contacts the inner peripheral surface 711C of the fixing belt 711 will be called "distal region RA". A region on the outer surface 746 of the base part 741 that includes a bordering area 742 (a region bordering one of the ribs 743) will be called "first surface region RB". That is, the first surface region RB is located adjacent to one of the ribs 743. Another region on the outer surface 746 of the base part 741 separated from the same rib 743 by the first surface region RB will be called "second surface region RC". A region on the surface 747 of the rib 743 between the distal region RA and the outer surface 746 of the base part 741 (a region connecting the distal end region RA and the corresponding bordering area 742) will be called "side surface region RD". The side surface region RD also includes a bordering area (a region bordering the first surface region RB on the outer surface 746 of the base part 741).

Further, in the side wall 740U shown in FIG. 4, a region constituting an upper half of the outer surface 746 on the base part 741 of the 740 (an upstream region in the moving direction H) will be called "upper region RH", while a region constituting a lower half of the outer surface 746 of the base part 741 (a downstream region in moving direction H) will be called "lower region RL". Put another way, the lower region RL is arranged closer to the nip region P than the upper region RH is to the nip region P in the moving direction H of the fixing belt 711. The lower region RL is an example of "second rough region" and the upper region RH is an example of "first rough region".

Incidentally, in FIG. 4, for facilitating understanding, phantom lines indicating the respective regions RA, RB, RC, RH and RL are shown so as not to overlap with each other.

In the enlarged view of FIG. 4, glass fibers 760 that are raised higher from the outer surface 746 of the base part 741 and the surface 747 of the rib 743 are depicted darker, while glass fibers 760 with a lower raised height are depicted lighter. As shown in the enlarged view of FIG. 4, the raised height of the glass fibers 760 differ among the various regions RA, RB, RC, and RD of the guide member 712. The raised height of the glass fibers 760 in these regions RA, RB, RC, and RD will be described next in greater detail.

Figure 5:
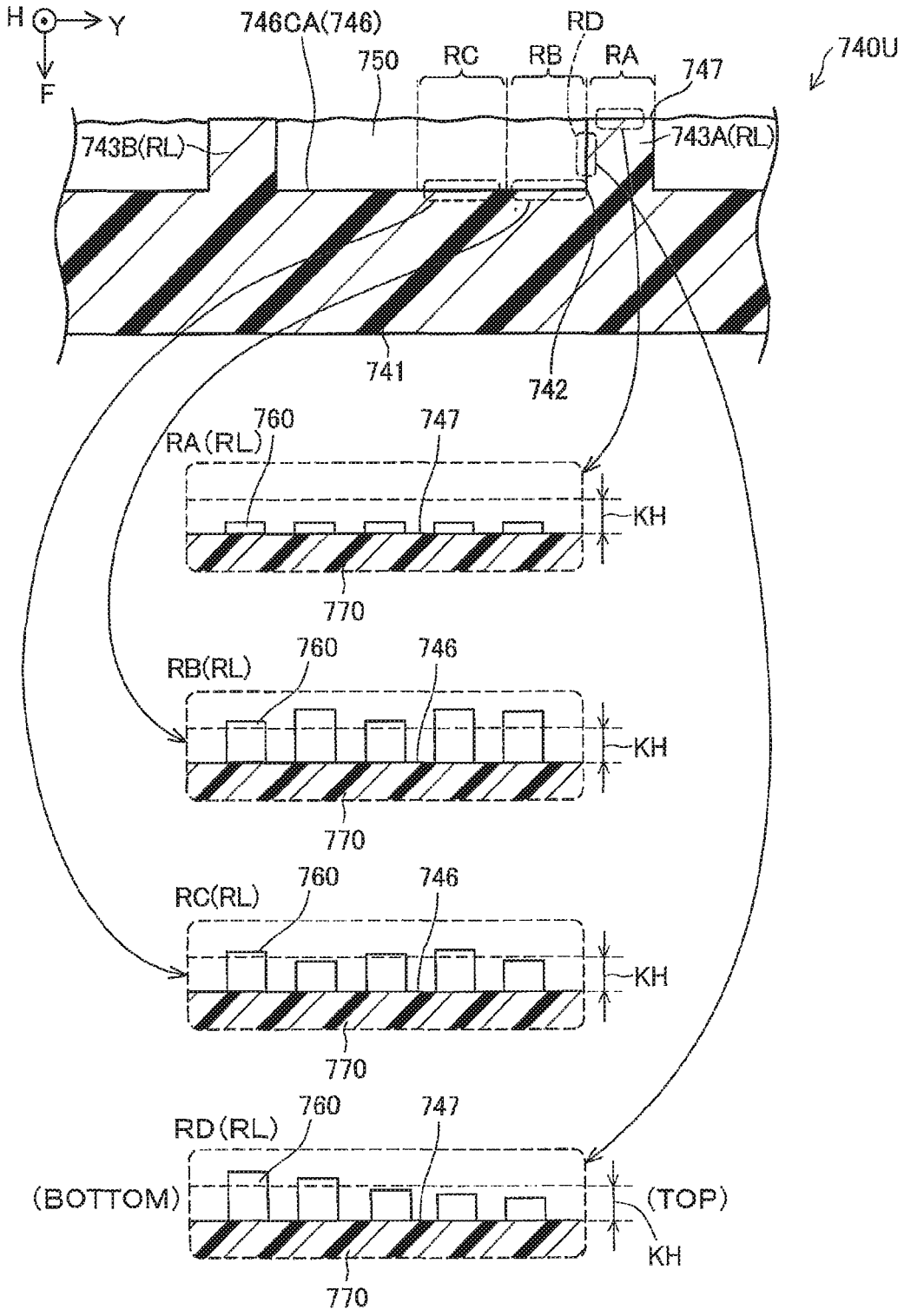
FIG. 5 is a schematic cross-sectional view of the side wall taken along a plane V-V in FIG. 4.

FIG. 5 schematically illustrates a cross-sectional structure of the side wall 740 (upstream side wall 740U) taken along a plane V-V in FIG. 4, and specifically illustrates a cross-sectional structure in the lower region RL of the upstream side wall 740U. In FIG. 5, two neighboring ribs 743A and 743B are depicted as part of the cross-sectional structure of the upstream side wall 740U. The first surface region RB and second surface region RC are arranged between the neighboring ribs 743A and 743B.

The rib 743A is an example of a first protrusion, and the rib 743B is an example of a second protrusion. The distal end regions RA are an example of "distal end surface". The distal region RA of the rib 743A is also an example of "first distal end surface", and the distal region RA of the rib 743B is also an example of "second distal end surface". The side surface regions RD of the ribs 743 are an example of "side surface". The side surface region RD of the rib 743A is also an example of "first side surface", and the side surface region RD of the rib 743B is also an example of "second side surface". A part of the outer surface 746 of the base part 741 between the neighboring two ribs 743 (between the rib 743A and rib 743B: shown with a reference numeral 746CA in FIGS. 4, 5 and 6) is an example of "connecting area". That is, the "connecting area" includes the first surface region RB and second surface region RC.

FIG. 5 includes enlarged cross-sectional views for each of the regions RA, RB, RC, and RD. In the enlarged cross-sectional views, the glass fibers 760 raised from the liquid-crystal polymer 770 on the outer surface 746 of the base part 741 and on the surface 747 of the rib 743 are schematically depicted using rectangular boxes, where heights of these boxes denote the raised heights of the glass fibers 760.

In the present embodiment, a reference value KH is used to determine the raised height of glass fibers 760 in the regions RA, RB, RC, and RD. Specifically, a ratio of glass fibers 760 that protrude at least as far as the reference value KH to a total number of raised glass fibers 760 (hereinafter called the "high-fiber ratio") is determined for each of the regions RA, RB, RC, and RD. Here, the reference value KH signifies a raised height of glass fibers 760 constituting a surface with a reference surface roughness, and specifically is 0.6 μm in the present embodiment. Hence, a large high-fiber ratio indicates a higher surface roughness (i.e., coarser). In this example, surface roughness signifies roughness of a surface having a Ra value no greater than 50.0 μm and is at least an order of magnitude smaller than the largest protruding length of the ribs 743 from the base part 741.

Surface roughness results from irregularities in the outer surface 746 of the base part 741 and the surfaces 747 of the ribs 743 distributed in the longitudinal direction and in the moving direction H of the fixing belt 711. Profile deviations resulting in surface roughness may be attributable to the glass fibers 760 protruding from the liquid-crystal polymer 770, polishing marks left from polishing the liquid-crystal polymer 770 with a polishing roller 22 described later (see FIG. 9), the surface roughness of a mold 32 described later (see FIG. 11) used for molding the guide member 712, and the like. Note that the parameter Ra in this description conforms to the definition in JIS B 0601:2013. The parameter Ra for the outer surface 746 of the base part 741 and the surface 747 of the rib 743 can be derived by measuring these surfaces with a laser microscope.

In the enlarged cross-sectional view of FIG. 5 for the distal region RA, the five glass fibers 760 protruding from the liquid-crystal polymer 770 constituting the surface 747 of the rib 743 all have a lower raised height than the reference value KH and, hence, the high-fiber ratio in the distal region RA is 0. In the first surface region RB, the five glass fibers 760 protruding from the liquid-crystal polymer 770 constituting the outer surface 746 of the base part 741 all have a greater raised height than the reference value KH and, hence, the high-fiber ratio in the first surface region RB is 1. In the second surface region RC, three of the five glass fibers 760 protruding from the liquid-crystal polymer 770 constituting the outer surface 746 of the base part 741 have a height greater than the reference value KH and, hence, the high-fiber ratio in the second surface region RC is 0.6. In the side surface region RD, two of the five glass fibers 760 protruding from the liquid-crystal polymer 770 constituting the surface 747 of the rib 743 have a height greater than the reference value KH and, hence, the high-fiber ratio in the side surface region RD is 0.4. Here, a probability density function ADF (in conformance with JIS B 0601:2001) can be derived by measuring the outer surface 746 of the base part 741 and the surfaces 747 of the ribs 743 with a laser microscope, and the high-fiber ratio can be compared using the ADF. Alternatively, the raised height of each glass fibers 760 within a unit area may be measured one-by-one using a laser microscope or the like to find the high-fiber ratio.

In other words, the high-fiber ratio in the side surface region RD, first surface region RB, and second surface region RC is larger than the high-fiber ratio in the distal region RA and, hence, the surface roughness in the side surface region RD, first surface region RB and second surface region RC is higher than the surface roughness in the distal region RA. In the guide member 712 of the present embodiment, the surfaces in the side surface region RD, first surface region RB, and second surface region RC constitute a rough region (coarse region) RR having a higher surface roughness than the surface roughness in the distal region RA. Further, the high-fiber ratio for the first surface region RB is larger (greater) than that for the second surface region RC and, hence, the surface roughness in the first surface region RB is larger (higher) than that in the second surface region RC.

In the example of the embodiment, as shown in a table of FIG. 7, the parameter Ra (hereinafter called the "surface roughness Ra") denoting surface roughness in the lower region RL of the side surface region RD is 3.0 Min; the surface roughness Ra in the lower region RL of the first surface region RB is 3.0 μm; the surface roughness Ra in the lower region RL of the second surface region RC is 2.0 μm; and the surface roughness Ra in the lower region RL of the distal region RA is 0.4 μm.

Under the condition of satisfying the above magnitude relationships, the surface roughness Ra in the lower region RL of the side surface region RD may be any value in a range of 3.0-3.5 μm; the surface roughness Ra in the lower region RL of the first surface region RB may be any value in a range of 3.0-3.5 μm; the surface roughness Ra in the lower region RL of the second surface region RC may be any value in a range of 2.0-2.4 μm; and the surface roughness Ra in the lower region RL of the distal region RA may be any value in a range of 0.4-1.0 μm.

Figure 6:
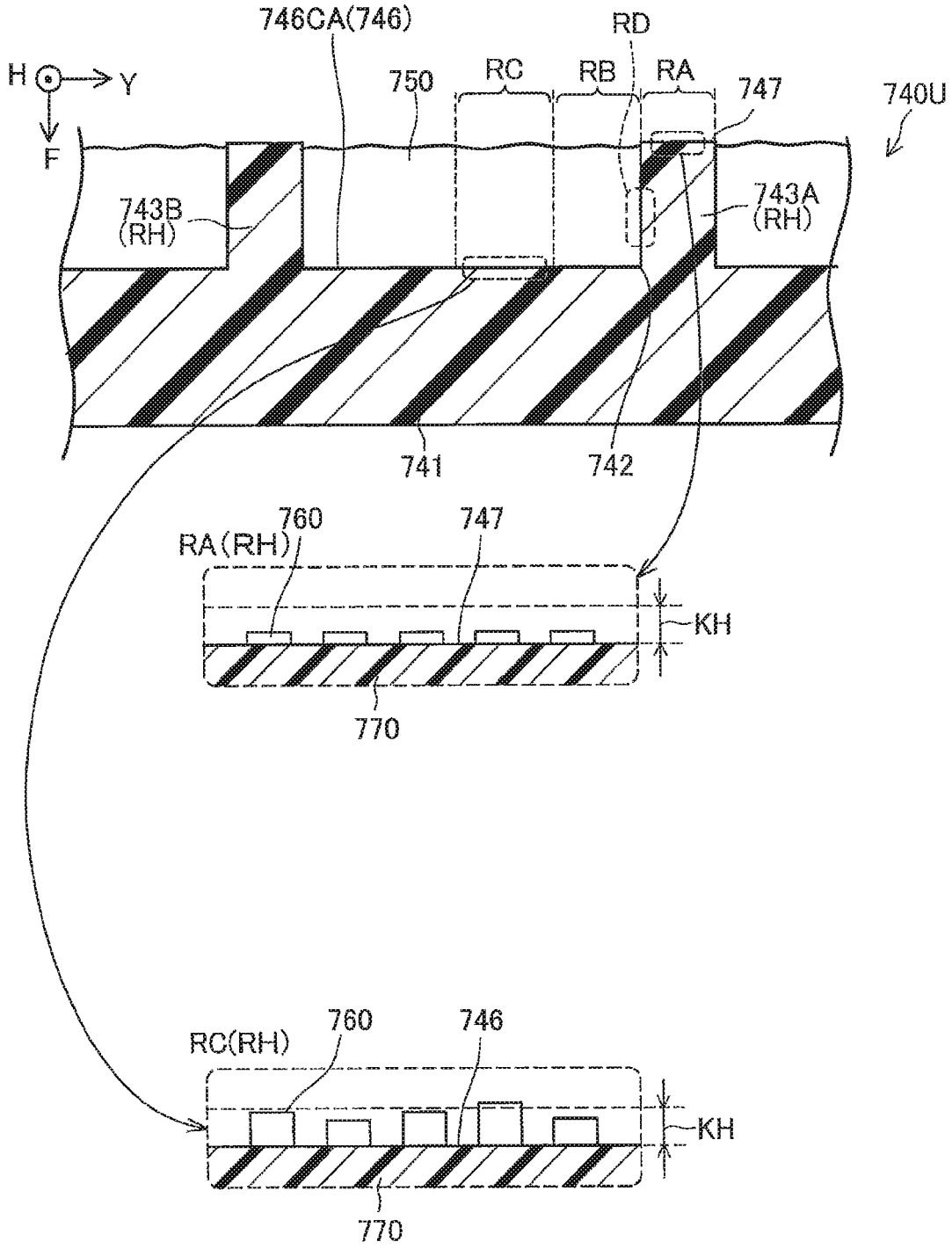
FIG. 6 is a schematic cross-sectional view of the side wall taken along a plane VI-VI in FIG. 4.

FIG. 6 is an explanatory diagram schematically illustrating a cross-sectional structure of the side wall 740 (upstream side wall 740U) taken along a plane VI-VI in FIG. 4. That is, FIG. 6 schematically illustrates the cross-sectional structure for the upper region RH of the side wall 740 (upstream side wall 740U). As shown in FIGS. 5 and 6, the rib 743A protrudes farther in the upper region RH than in the lower region RL.

FIG. 6 shows enlarged cross-sectional views of the distal region RA and second surface region RC in the upper region RH. The high-fiber ratio for the distal region RA in the upper region RH is 0, which is equivalent to the high-fiber ratio for the distal region RA in the lower region RL. The high-fiber ratio for the second surface region RC in the upper region RH is 0.2, which is greater than the high-fiber ratio for the distal region RA in the upper region RH and smaller than the high-fiber ratio for the second surface region RC in the lower region RL. The surface roughness in the upper region RH of the second surface region RC is higher than that in the upper region RH of the distal region RA, while the surface roughness in the lower region RL of the second surface region RC is higher than the surface roughness in the upper region RH of the second surface region RC.

In the example of the embodiment, referring to the table of FIG. 7, the surface roughness Ra in the upper region RH of the side surface region RD is 2.5 μm; the surface roughness Ra in the upper region RH of the first surface region RB is 2.5 μm; the surface roughness Ra in the upper region RH of the second surface region RC is 1.5 μm; and the surface roughness Ra in the upper region RH of the distal region RA is 0.4 μm.

Under the condition of meeting the above magnitude relationships, the surface roughness Ra in the upper region RH of the side surface region RD may be any value in a range of 2.5-2.9 μm; the surface roughness Ra in the upper region RH of the first surface region RB may be any value in a range of 2.5-2.9 μm; the surface roughness Ra in the upper region RH of the second surface region RC may be any value in a range of 1.5-1.9 μm; and the surface roughness Ra in the upper region RH of the distal region RA may be any value in a range of 0.4-1.0 μm.

In both of the upper region RH and the lower region RL, the rough region RR (side surface regions RD, first surface regions RB and second surface regions RC) has surface roughness higher than the surface roughness of the distal end regions RA of the ribs 743. That is, in both of the upper region RH and the lower region RL, the rough region RR (side surface regions RD, first surface regions RB and second surface regions RC) is made to be coarser than the distal end regions RA of the ribs 743.

As described above, in the present embodiment, the guide member 712 is provided with ribs 743. The side surface regions RD of the ribs 743 and the outer surfaces 746 of the base parts 741 are provided with regions having surface roughness different from that in the distal regions RA of the ribs 743. That is, in the present embodiment, the side surface regions RD, first surface regions RB and second surface regions RC constitute the rough region RR.

Here, as a comparative example, assume that the surface roughness in the side surface regions RD of the ribs 743 and in the outer surfaces 746 of the base parts 741 were set identical to that in the distal regions RA of the ribs 743 and the surface roughness in the side surface regions RD of the ribs 743 and the outer surfaces 746 of the base parts 741 were set relatively low in order to suppress sliding friction between the fixing belt 711 and guide member 712, for example. This configuration could not restrain leakage of the lubricant 750 from between the fixing belt 711 and guide member 712. Alternatively, assume that the surface roughness in the distal regions RA of the ribs 743 were set relatively large to suppress the lubricant 750 from flowing out from between the fixing belt 711 and guide member 712, for example. This configuration could not reduce sliding friction between the fixing belt 711 and guide member 712. In other words, when the surface roughness in the side surface regions RD of the ribs 743 and in the outer surfaces 746 of the base parts 741 is equivalent to the surface roughness in the distal regions RA of the ribs 743, such configuration cannot simultaneously reduce sliding friction between the fixing belt 711 and guide member 712 and suppress leakage of the lubricant 750 from between the fixing belt 711 and guide member 712.

In contrast, in the present embodiment, the side surface regions RD of the ribs 743 and the outer surfaces 746 of the base parts 741 are provided with regions having surface roughness different from that in the distal regions RA of the ribs 743. More specifically, the side surface regions RD of the ribs 743 and the outer surfaces 746 of the base parts 741 are provided with the rough region RR having higher surface roughness than that in the distal regions RA of the ribs 743. Accordingly, the distal end region RA of the ribs 743, which have a relative low surface roughness, can be used to suppress sliding friction between the fixing belt 711 and guide member 712. Further, the side surface regions RD of the ribs 743 and the outer surfaces 746 of the base parts 741, which have a relatively high surface roughness, can be used to retain the lubricant 750 by suppressing outflow of the lubricant 750 from between the fixing belt 711 and guide member 712. Thus, this configuration of the present embodiment can suppress depletion of the lubricant 750 that is supplied to the distal regions RA of the ribs 743 as well as reduce sliding friction between the fixing belt 711 and guide member 712.

Further, the longitudinal direction of the ribs 743 is substantially parallel to the moving direction H. The ribs 743 are arranged on the corresponding outer surface 746 at intervals in the longitudinal direction of the fixing belt 711 orthogonal to the moving direction H of the fixing belt 711 such that two neighboring ribs 743A and 743B are spaced apart from each other. Hence, space is formed between the inner peripheral surface 711C of the fixing belt 711 and the outer surface 746 of the base part 741 in an area between the neighboring ribs 743A and 743B, meaning that the lubricant 750 is likely to flow out of this space. However, in the present embodiment, the first surface region RB and second surface region RC are formed as the rough region RR disposed between the ribs 743A and 743B. This configuration can better restrain the lubricant 750 from flowing out from between the fixing belt 711 and guide member 712 than a configuration that does not provide such rough region RR between the ribs 743A and 743B.

Further, in the present embodiment, the guide member 712 is formed of a filler-containing resin that includes the glass fibers 760 dispersed in the liquid-crystal polymer 770. The glass fibers 760 protrude from the liquid-crystal polymer 770 constituting the side surface regions RD of the ribs 743 and the outer surfaces 746 of the base parts 741. The protruding glass fibers 760 can serve to restrain the lubricant 750 from flowing out from between the fixing belt 711 and guide member 712.

In particular, the guide member 712 of the present embodiment is formed by injecting the filler-containing resin in the longitudinal direction of the fixing belt 711, as will be described later. Hence, the glass fibers 760 protruding relative to the side surface regions RD of the ribs 743 and the outer surfaces 746 of the base parts 741 extend in directions that cross the moving direction H of the fixing belt 711. This configuration can better retain the lubricant 750 on the outer surfaces 746 of the base parts 741 than if the glass fibers 760 extended in the moving direction H of the fixing belt 711.

Incidentally, the glass fibers 760 are also raised from the liquid-crystal polymer 770 constituting the distal regions RA of the ribs 743. However, in the present embodiment, the high-fiber ratio in the distal regions RA of the ribs 743 is smaller than the high-fiber ratio in the first surface regions RB and second surface regions RC constituting the rough region RR on the corresponding outer surface 746. Accordingly, this configuration can suppress sliding friction between the fixing belt 711 and guide member 712.

The glass fibers 760 are harder than polyimide resin, which is the material forming the inner peripheral surface 711C of the fixing belt 711. Hence, the distal regions RA of the ribs 743 are prevented from being worn down by the circulating fixing belt 711. On the other hand, the inner peripheral surface 711C of the fixing belt 711 may be worn down by the glass fibers 760 protruding from the distal regions RA of the respective ribs 743. However, in the depicted embodiment, the high-fiber ratio in the distal regions RA of the ribs 743 is lower than that in the first and second surface regions RB and RC constituting the rough region RR, thereby suppressing wear on the inner peripheral surface 711C of the fixing belt 711.

Further, in the depicted embodiment, both the first and second surface regions RB and RC in the outer surface 746 of each base part 741 constitute the rough region RR. Accordingly, the outer surfaces 746 of the base parts 741 of the embodiment (first and second surface regions RB and RC both formed as the rough region RR) can retain more lubricant 750 than if only one of the first and second surface regions RB and RC were formed as the rough region RR. Further, in the present embodiment, the first surface region RB is arranged closer to the rib 743A than the second surface region RC is to the rib 743A, and the surface roughness in the first surface region RB is higher than that in the second surface region RC. This configuration can retain the lubricant 750 close to the rib 743A so that the retained lubricant 750 can readily be supplied to the distal region RA of the rib 743A.

Still further, in the present embodiment, the rib 743A protrudes farther in the upper region RH than in the lower region RL. That is, the rib 743A has a larger protruding length in the upper region RH than in the lower region RL. Consequently, the lubricant 750 interposed between the fixing belt 711 and guide member 712 can more easily flow out from the lower region RL than from the upper region RH. However, in the present embodiment, the surface roughness in the rough region RR of the lower region RL is made higher than that in the rough region RR of the upper region RH, for example, by setting the surface roughness of the second surface region RC in the lower region RL higher than that in the upper region RH. This configuration can restrain flowing out of the lubricant 750 from between the fixing belt 711 and guide member 712 in the lower region RL.

<How to Manufacture the Fixing Device>

Figure 8:
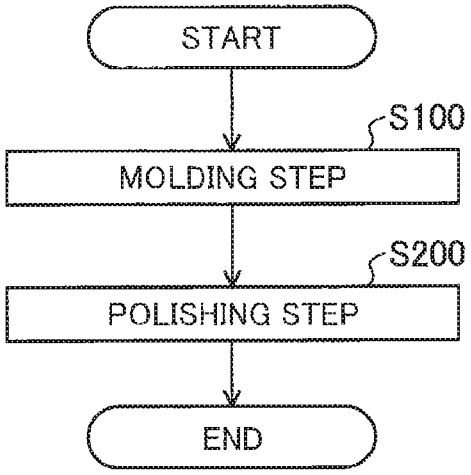
FIG. 8 is a flowchart for description of a process for manufacturing the guide member.

Next, a method of manufacturing the fixing device 700 according to the embodiment will be described with reference to FIGS. 8 and 9.

The method of manufacturing the fixing device 700 includes a process for manufacturing the guide member 712. FIG. 8 is a flowchart illustrating steps in the process for manufacturing the guide member 712. The process for manufacturing the guide member 712 includes a molding step S100 and a polishing step S200.

In the molding step S100, there is prepared a mold having an injection hole formed in one end of the mold in the longitudinal direction of the fixing belt 711. The guide member 712 is molded by injecting resin into a cavity of the mold through the injection hole in the longitudinal direction of the fixing belt 711. The resin from which the guide member 712 is molded includes the glass fibers 760 as fillers dispersed in the liquid-crystal polymer 770 (hereinafter called "filler-containing resin"). Using the glass fibers 760 as fillers in the liquid-crystal polymer 770 having high heat resistance can improve strength of the guide member 712. Here, the glass fibers 760 are harder than the hollow resin tube 711B (formed of polyimide resin) constituting the inner peripheral surface 711C of the fixing belt 711.

After completing the molding step S100, the polishing step S200 is performed. FIG. 9 is a schematic diagram showing a general structure of a polishing device 20 used in the polishing step S200. The polishing device 20 includes a controller 21, a motor M, and the polishing roller 22. The controller 21 is configured to control components of the polishing device 20 by outputting commands to the motor M. The motor M is configured to drive the polishing roller 22 based on signals outputted from the controller 21. The polishing roller 22 is a cylindrical member that is elongated in the longitudinal direction of the fixing belt 711. The polishing roller 22 is a polishing member that is disposed to be rotatable about an axis aligned in the longitudinal direction of the fixing belt 711. The polishing roller 22 is also movable in the longitudinal direction of the fixing belt 711.

In the polishing step S200, the polishing roller 22 is positioned relative to the guide member 712 at a position based on the height of the distal regions RA of the ribs 743, with the axis of the polishing roller 22 aligned in the longitudinal direction of the fixing belt 711. The controller 21 is configured to rotate the polishing roller 22 about its axis at a rotational velocity VA. The polishing roller 22 has an outer circumference serving as a polishing surface 23. That is, the polishing surface 23 faces outward in a radial direction of the polishing roller 22 (a direction orthogonal to the longitudinal direction of the fixing belt 711). While the polishing roller 22 is being rotated about its axis, the polishing surface 23 is driven to move in the moving direction H of the fixing belt 711, thereby polishing the distal regions RA of the ribs 743 with a polishing pressure PH. Specifically, the polishing surface 23 polishes the glass fibers 760 protruding from the liquid-crystal polymer 770 constituting the distal regions RA on the ribs 743 until the raised height of the glass fibers 760 in these distal regions RA becomes smaller than the reference value KH (see FIGS. 5 and 6).

Further, the controller 21 is configured to move the polishing roller 22 also in the longitudinal direction of the fixing belt 711 at a moving velocity VB. The rotational velocity VA is set faster than the moving velocity VB. Consequently, polishing marks formed in the distal regions RA of the ribs 743 are aligned in the moving direction H of the fixing belt 711, even while the polishing roller 22 is being moved in the longitudinal direction of the fixing belt 711.

Figure 9:
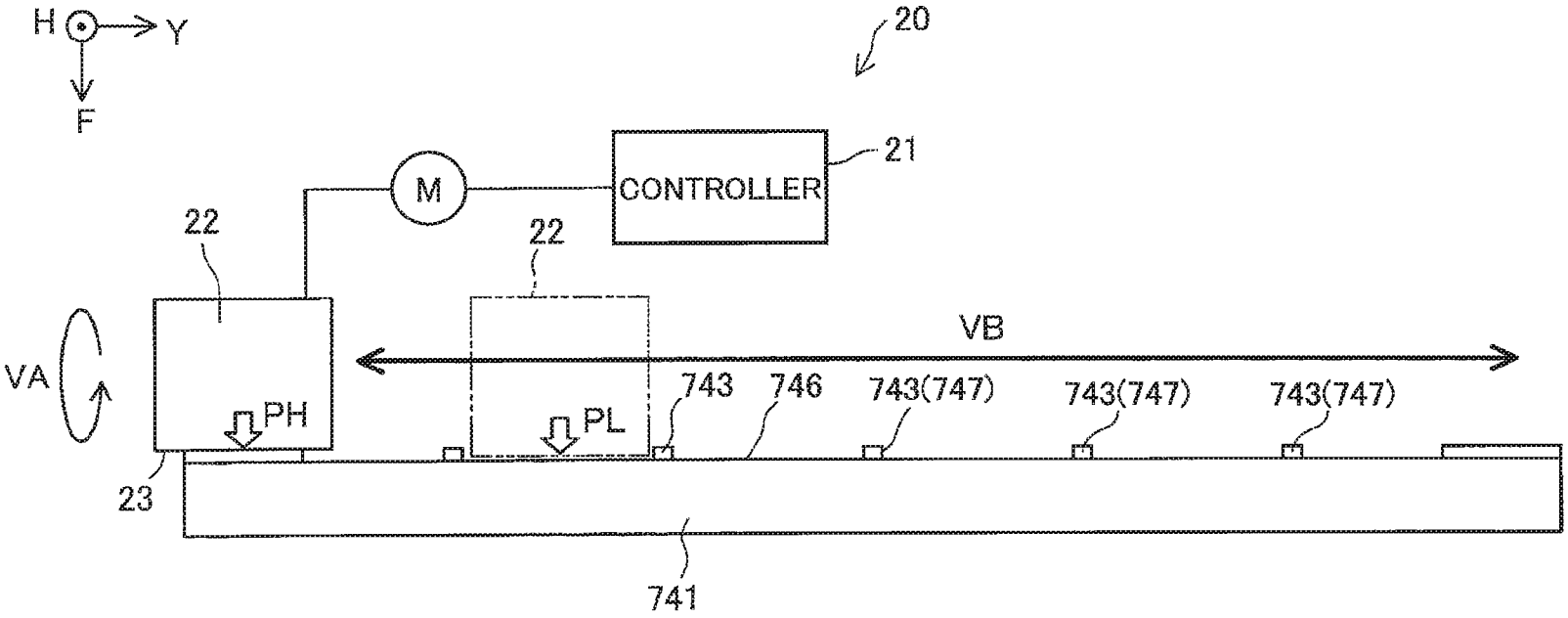
FIG. 9 is a schematic view of a polishing device used in the process of FIG. 8.

As depicted with phantom lines in FIG. 9, the polishing roller 22 is configured to move over the outer surface 746 of the base part 741 in the longitudinal direction of the fixing belt 711 (parallel to the Y-axis) and polish the side surface regions RD of the ribs 743 and the outer surface 746 of the base part 741. In the polishing step S200, the polishing roller 22 is disposed at a position based on the distal regions RA of the ribs 743. Hence, the polishing roller 22 applies a polishing pressure PL, which is smaller than the polishing pressure PH applied to the distal regions RA, to the outer surface 746 of the base part 741 that is positioned lower than the distal regions RA of the ribs 743 in the conveying direction F.

In other words, the polishing conditions at which the distal regions RA in the ribs 743 are polished differ from the polishing conditions at which the side surface regions RD of the ribs 743 and the outer surface 746 of the base part 741 are polished. Accordingly, at least some of the glass fibers 760 protruding from the outer surface 746 of the base part 741 in the second surface region RC, for example, have a greater raised height than the reference value KH (see FIGS. 5 and 6). In particular, due to the ribs 743 interfering with the polishing roller 22, the polishing surface 23 cannot contact the bordering areas 742 of the base part 741 that border the ribs 743 and the bordering areas on the side surface regions RD that border the base part 741. Consequently, all glass fibers 760 protruding in these regions remain unpolished and, hence, have a greater raised height than the reference value KH (see FIG. 5). As a result, the surface roughness in the side surface regions RD and on the outer surface 746 of the base part 741 is higher than the surface roughness in the distal regions RA.

In this way, the process of manufacturing the guide member 712 according to the embodiment includes the polishing step (S200 in FIG. 8) in which the polishing surface 23 of the polishing roller 22 polishes the distal regions RA of the ribs 743. In the polishing step S200, the polishing surface 23 of the polishing roller 22 polishes the glass fibers 760 raised from the distal regions RA of the ribs 743. By including the polishing step in the manufacturing process for the guide member 712, the guide member 712 described above can be fabricated, so that the surface roughness in the side surface regions RD of the ribs 743 and in the outer surfaces 746 of the base parts 741 is higher than the surface roughness in the distal regions RA of the ribs 743.

Specifically, in the polishing step of the embodiment, the polishing roller 22 is configured to rotate so that the polishing surface 23 on the polishing roller 22 can move in the moving direction H of the fixing belt 711 to polish the distal regions RA of the ribs 743. The polishing roller 22 is also moved in the longitudinal direction of the fixing belt 711 orthogonal to the moving direction H of the fixing belt 711 so that the polishing surface 23 on the polishing roller 22 uniformly polishes the distal regions RA of the ribs 743 in the longitudinal direction of the fixing belt 711. Further, after each time the polishing roller 22 has been moved across the longitudinal dimension of the fixing belt 711, the polishing roller 22 is gradually moved over the ribs 743 in the moving direction H from the upper region RH toward the lower region RL. The average force with which the polishing roller 22 contacts the guide member 712 is greater when the polishing roller 22 is positioned in the upper region RH than when the polishing roller 22 is positioned in the lower region RL. In the present embodiment, the polishing surface 23 on the polishing roller 22 is moved both in the moving direction H of the fixing belt 711 and in the longitudinal direction of the fixing belt 711. However, since the rotational velocity VA at which the polishing surface 23 moves in the moving direction H of the fixing belt 711 is faster than the moving velocity VB at which the polishing surface 23 moves in the longitudinal direction of the fixing belt 711, polishing marks formed in the distal regions RA of the ribs 743 are aligned in the moving direction H of the fixing belt 711. Accordingly, this method can better suppress sliding friction between the fixing belt 711 and guide member 712 than if the polishing surface 23 were to form polishing marks in the distal regions RA of the ribs 743 that intersect the moving direction H of the fixing belt 711.

Further, since the polishing surface 23 of the polishing roller 22 is moved in the longitudinal direction of the fixing belt 711 in the polishing step while also being moved in the moving direction H of the fixing belt 711, the polishing surface 23 can also polish the side surface regions RD of the ribs 743 and the outer surfaces 746 of the base parts 741. In the present embodiment, the polishing surface 23 of the polishing roller 22 polishes the side surface regions RD of the ribs 743 and the outer surfaces 746 of the base parts 741 with the polishing pressure PL that is lower than the polishing pressure PH with which the polishing surface 23 polishes the distal regions RA of the ribs 743. Thus, the polishing surface 23 removes a smaller amount from the side surface regions RD of the ribs 743 and the outer surfaces 746 of the base parts 741 than from the distal regions RA of the ribs 743. Accordingly, the polishing step in the present embodiment can leave the rough region RR, which has higher surface roughness than the distal regions RA of the ribs 743, on the side surface regions RD of the ribs 743 and the outer surfaces 746 of the base parts 741.

In particular, in the present embodiment, the polishing surface 23 does not contact the bordering areas 742 on the base parts 741 that border the ribs 743 or the bordering parts on the side surface regions RD that border the base parts 741 due to interference between the polishing roller 22 and the rib 743A (contact pressure=0) and, therefore, does not polish these regions. In other words, contact pressure with which the polishing surface 23 applies to the bordering areas 742 of the first surface regions RB or the bordering parts on the side surface regions RD is smaller than the pressure PL. As a result, this polishing process can leave higher surface roughness in these bordering parts than in all other regions in the side surface region RD of the rib 743 and the outer surface 746 of the base part 741. This arrangement can retain the lubricant 750 near the rib 743.

Figure 10:
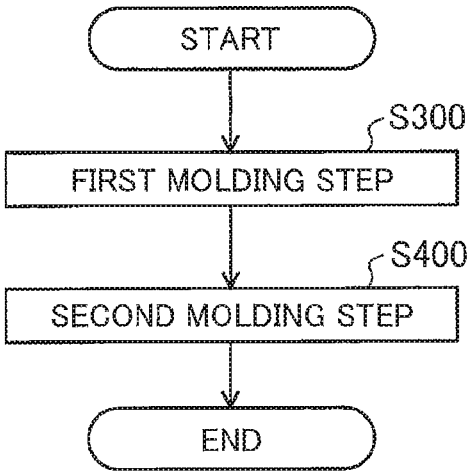
FIG. 10 is a flowchart for description of another process for manufacturing the guide member according to a modification to the embodiment.

FIG. 10 is a flowchart illustrating steps in another process for manufacturing the guide member 712 according to a variation of the embodiment. The manufacturing process according to this variation omits the polishing step S200 from the embodiment described above (see FIG. 8). The structure of the printer 10 according to the variation is identical to that of the depicted embodiment, and, hence, like parts and components are designated with the same reference numerals as those in the embodiment to avoid duplicating description.

Figure 11:
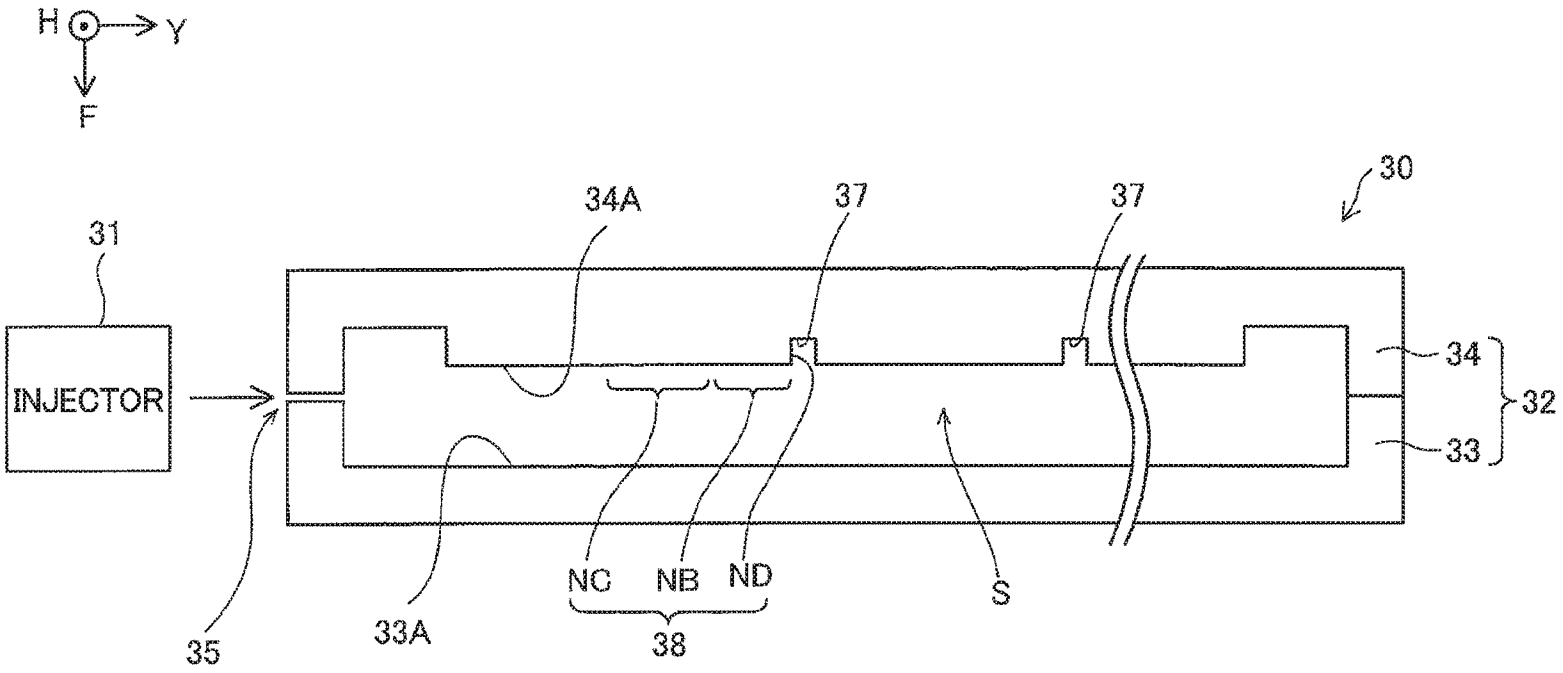
FIG. 11 is a schematic view of a molding machine used in the process of FIG. 10.

As shown in FIG. 10, the process of manufacturing the guide member 712 according to the variation includes a first molding step S300 and a second molding step S400. FIG. 11 is a schematic diagram showing an overall structure of a molding machine 30 employed in the first molding step S300 and second molding step S400. The molding machine 30 includes an injector 31, and the mold 32. The injector 31 is configured to inject a filler-containing resin into an internal cavity S of the mold 32 through an injection hole 35 formed in the mold 32.

The mold 32 is formed of a metal and includes a first die 33 and a second die 34. The first die 33 has an inner molding surface 33A for forming inner surfaces of the side walls 740 constituting the guide member 712. The second die 34 has an outer molding surface 34A for forming the outer surfaces of the side walls 740 constituting the guide member 712, that is, the outer surfaces 746 on the base parts 741 and the surfaces 747 on the ribs 743.

The outer molding surface 34A includes first molding surfaces 37 for forming the distal regions RA of the ribs 743, and second molding surfaces 38 for forming the side surface regions RD of the ribs 743 and the outer surfaces 746 of the base parts 741. Each of the second molding surfaces 38 further includes a first molding region NB for forming the first surface regions RB of the guide member 712, a second molding region NC for forming the second surface regions RC of the guide member 712, and a side-surface molding region ND for forming the side surface regions RD of the ribs 743. The second die 34 is formed such that the surface roughness of the second molding surfaces 38 is higher than the surface roughness of the first molding surfaces 37. Additionally, the second molding surfaces 38 are formed such that the surface roughness in the second molding regions NC is lower than the surface roughness in the first molding regions NB.

In the first molding step S300 and second molding step S400, the injector 31 injects filler-containing resin into the cavity S of the mold 32. When the filler-containing resin is injected into the cavity S, the first molding surfaces 37 form the distal regions RA of the ribs 743, while the second molding surfaces 38 mold the side surface regions RD of the ribs 743 and the outer surfaces 746 of the base parts 741. More specifically, the side-surface molding regions ND of the second molding surfaces 38 mold the side surface regions RD of the ribs 743; the first molding regions NB of the second molding surfaces 38 mold the first surface regions RB; and the second molding regions NC of the second molding surfaces 38 mold the second surface regions RC.

As described above, the second die 34 is configured such that the surface roughness of the second molding surfaces 38 is higher than that of the first molding surfaces 37. Consequently, in the guide member 712 molded according to this manufacturing process, the surface roughness in the distal regions RA of the ribs 743 is lower than the surface roughness in the side surface regions RD of the ribs 743 and in the outer surfaces 746 of the base parts 741. Therefore, the side surface regions RD of the ribs 743 and the outer surfaces 746 of the base parts 741 are formed as the rough region RR whose surface roughness is lower than that in the distal regions RA of the ribs 743. Further, the second molding surfaces 38 are formed such that the surface roughness in the second molding regions NC is lower than the surface roughness in the first molding regions NB. Thus, the molded guide member 712 is molded such that the surface roughness in the second surface regions RC of the base parts 741 is lower than the surface roughness in the first surface regions RB of the base parts 741.

The process for manufacturing the guide member 712 in the variation of the embodiment includes the first molding step and the second molding step for molding the guide member 712 in the mold 32. In the first molding step, the first molding surfaces 37 form the distal regions RA of the ribs 743. In the second molding step, the second molding surfaces 38 form the side surface regions RD of the ribs 743 and the outer surfaces 746 of the base parts 741. Since the second molding surfaces 38 have a higher surface roughness than the first molding surfaces 37, these molding steps can produce the above-described guide member 712 whose side surface regions RD of the ribs 743 and outer surfaces 746 of the base parts 741 have a higher surface roughness than the distal regions RA of the ribs 743.

The second molding surfaces 38 include the first molding regions NB for forming the first surface regions RB in the guide member 712, and the second molding regions NC for forming the second surface regions RC of the guide member 712. The surface roughness in the second molding regions NC is lower than the surface roughness in the first molding regions NB. Accordingly, the first surface regions RB, which are disposed closer to the corresponding ribs 743 than are the corresponding second surface regions RC, can be formed with a higher surface roughness than that of the second surface regions RC in order to retain the lubricant 750 near the ribs 743.

<Other Variations and Modifications>

While the disclosure is described in detail with reference to the specific embodiment thereof, other variations and modifications are also conceivable.

In the embodiment, a tubular (endless) fixing belt 711 is illustrated as an example of the belt in the fixing device, but the belt may be configured with ends.

While the fixing belt 711 serving as the belt of the fixing device in the embodiment is formed of a resin material, the belt may be formed of a metal, such as stainless steel.

In the embodiment described above, the belt of the fixing device is provided in the heating member 710, but the belt may be provided in the pressing member 720 instead. In this case, a guide member would also be provided in the pressing member 720.

The pressing member 720 in the fixing device of the depicted embodiment is described as a roller, but the pressing member may be a belt-shaped member instead.

The ribs 743 extending in the moving direction H of the fixing belt 711 are employed as protrusions of the guide member in the embodiment. But the guide member may be provided with dot-like protrusions that extend neither in the circulating direction of the belt nor in a direction orthogonal thereto.

The ribs 743 provided on the guide member 712 in the embodiment have a rectangular cross section, but the cross section of the ribs may be parabolic in shape, for example.

In the embodiment described above, the surface roughness in the outer surfaces 746 of the base parts 741 and the surfaces 747 on the ribs 743 is determined according to a high-fiber ratio, but a surface roughness may be determined using a ratio of a surface area occupied by fillers protruding at least the reference value KH to a surface area of the target region, for example.

In the embodiment, the first and second surface regions RB and RC of the base parts 741 and the side surface regions RD of the ribs 743 are used as examples of the rough region, but just one of the first and second surface regions RB and RC and side surface regions RD may serve as the rough region.

In the embodiment described above, the first and second surface regions RB and RC and side surface regions RD in their entirety serve as an example of the rough region RR. However, at least one of the surface regions RB, RC and RD may have a portion constituting the rough region, for example.

In the embodiment, the same rib 743A constitutes both the first protrusion and the third protrusion. However, the first and third protrusions may be configured as separate protrusions.

In the depicted embodiment, the surface roughness Ra in the first surface region RB is set higher in the lower region RL corresponding to the second rough region than in the upper region RH corresponding to the first rough region. However, the surface roughness Ra in the first surface region RB may be set to the same or lower value in the lower region RL than in the upper region RH. The same settings may be used for the second surface region RC and side surface region RD, as well.

In the process for manufacturing the guide member 712 according to the embodiment, the polishing surface 23 of the polishing roller 22 is moved in the longitudinal direction of the fixing belt 711 orthogonal to the moving direction H of the fixing belt 711, but the polishing surface 23 need not be moved in a direction orthogonal to the moving direction H.

In the process for manufacturing the guide member 712 according to the embodiment, the polishing surface 23 of the polishing roller 22 polishes the side surface regions RD of the ribs 743 and the outer surfaces 746 of the base parts 741. However, the polishing surface 23 need not polish the side surface regions RD and outer surfaces 746.

In the mold 32 used in the manufacturing process for the guide member 712 according to the variation of the embodiment, the first molding surfaces 37 and second molding surfaces 38 are formed in the same second die 34, but the first molding surfaces 37 and second molding surfaces 38 may be formed in separate dies.

The configuration of the printer 10 in the above embodiment is merely an example and may be modified. In the above embodiment, the printer 10 is a monochromatic printer with a single-color toner (black). However, type of color to be printed and number of colors are not limited to the above embodiment.

Further, the image-forming apparatus may include not only a printer, but also a copy machine, a facsimile machine, and a multi-function apparatus.

Further, while the halogen heater 713 is employed in the above-described embodiment, a heat source other than the halogen heater is available such as an infrared heater and a carbon heater.

While the disclosure is described in detail with reference to the specific embodiment thereof while referring to accompanying drawings, it would be apparent to those skilled in the art that many modifications and variations may be made therein without departing from the scope of the disclosure.

What is claimed is:

1. A fixing device comprising:

a belt having a surface;

a belt guide configured to guide movement of the belt, the belt guide comprising:

a base part having a surface;

a first protrusion protruding from the surface of the base part toward the surface of the belt, the first protrusion having a first distal end surface and a first side surface, the surface of the belt being configured to contact the first distal end surface, the first distal end surface having a first distal surface roughness, the first side surface connecting the first distal end surface and the surface of the base part; and a second protrusion protruding from the surface of the base part toward the surface of the belt, the second protrusion being positioned spaced away from the first protrusion, the second protrusion having a second distal end surface and a second side surface, the surface of the belt being configured to contact the second distal end surface, the second side surface connecting the second distal end surface and the surface of the base part, wherein the surface of the base part includes a connecting area connecting the first protrusion and the second protrusion, wherein at least one of the first side surface, the second side surface, and the connecting area includes a rough region having a surface roughness higher than the first distal surface roughness, wherein the belt guide includes resin and a plurality of fillers dispersed in the resin, some of the plurality of fillers protruding relative to a surface constituting the rough region, and wherein a first number of fillers protrude relative to the first distal end surface, a second number of fillers protruding relative to the surface constituting the rough region, a ratio of fillers that protrude higher than a reference height to the first number of the fillers in the first distal end surface being lower than a ratio of fillers that protrude higher than the reference height to the second number of fillers in the rough region.

2. The fixing device according to claim 1, further comprising:

a drive roller configured to move the belt in a moving direction, the drive roller defining an axis extending in an axial direction perpendicular to the moving direction; and lubricant provided between the surface of the belt and the belt guide, wherein the connecting area on the surface of the base part extends in the axial direction, the connecting area including the rough region.

3. The fixing device according to claim 2, wherein the connecting area comprises:

a first surface region having a first surface roughness, the first surface region including a bordering area bordering the first protrusion; and a second surface region having a second surface roughness, the second surface region being located farther away from the first protrusion than the first surface region is from the first protrusion in the axial direction, the first surface roughness being higher than the second surface roughness and the first distal surface roughness, the first surface region constituting the rough region.

4. The fixing device according to claim 2, further comprising a heater, wherein the belt is an endless belt, the belt and the drive roller being configured to provide a nip region therebetween for nipping a sheet therebetween to convey the sheet.

5. The fixing device according to claim 1, wherein the plurality of fillers has hardness higher than a hardness of the surface of the belt.

6. The fixing device according to claim 5, wherein the surface of the belt comprises resin.

7. The fixing device according to claim 1, wherein a third number of fillers protrude relative to the second distal end surface, a ratio of fillers that protrude higher than the reference height to the third number of the fillers in the second distal end surface being lower than the ratio of the fillers that protrude higher than the reference height to the second number of fillers in the rough region.

8. The fixing device according to claim 7, wherein the connecting area comprises:

a first surface region having a first surface roughness, the first surface region including a border area bordering the first protrusion; and a second surface region having a second surface roughness, the second surface region being located farther away from the first protrusion than the first surface region is from the first protrusion, the first surface roughness being higher than the second surface roughness and the first distal surface roughness, the first surface region constituting the rough region.

9. The fixing device according to claim 8, wherein the second surface region also constitutes the rough region, wherein the first surface roughness of the first surface region provides an Ra value that falls within a range of 3.0-3.5 μm, the second surface roughness of the second surface region providing an Ra value that falls within a range of 2.0-2.4 μm, where each of the Ra values is defined in conformance with JIS B 0601:2013 standard.

10. The fixing device according to claim 7, wherein the plurality of fillers is glass fibers.

11. The fixing device according to claim 7, further comprising a drive roller configured to move the belt in a moving direction, the belt and the drive roller being configured to provide a nip region therebetween for nipping a sheet therebetween to convey the sheet, wherein the connecting area includes the rough region, the rough region comprising a first rough region and a second rough region, the second rough region being arranged closer to the nip region than the first rough region is to the nip region in the moving direction of the belt, the second rough region having a surface roughness higher than a surface roughness of the first rough region.

12. The fixing device according to claim 1, wherein the plurality of fillers has an elongated shape.

13. The fixing device according to claim 1, further comprising a drive roller configured to move the belt in a moving direction, the belt and the drive roller being configured to provide a nip region therebetween for nipping a sheet therebetween to convey the sheet, wherein the connecting area includes the rough region, the rough region comprising a first rough region and a second rough region, the second rough region being arranged closer to the nip region than the first rough region is to the nip region in the moving direction of the belt, the second rough region having a surface roughness higher than a surface roughness of the first rough region.

14. The fixing device according to claim 1, further comprising a drive roller configured to move the belt in a moving direction, the belt and the drive roller being configured to provide a nip region therebetween for nipping a sheet therebetween to convey the sheet, wherein the first side surface of the first protrusion includes the rough region, the rough region comprising a first rough region and a second rough region, the second rough region being arranged closer to the nip region than the first rough region is to the nip region in the moving direction of the belt, the second rough region having a surface roughness higher than a surface roughness of the first rough region.

15. The fixing device according to claim 1, wherein the surface of the base part includes:

a first surface region including a bordering area bordering the first protrusion; and a second surface region located farther away from the first protrusion than the first surface region is from the first protrusion, wherein the first surface region, the second surface region and the first side surface constitute the rough region, and wherein the first surface region has a surface roughness whose Ra value falls within a range of 3.0-3.5 μm, the second surface region having a surface roughness whose Ra value falls within a range of 2.0-2.4 μm, the first side surface having a surface roughness whose Ra value falls within a range of 3.0-3.5 μm, where each of the Ra values is defined in conformance with JIS B 0601:2013 standard.

16. The fixing device according to claim 1, wherein the surface of the base part includes:

a first surface region including a bordering area bordering the first protrusion; and a second surface region located farther away from the first protrusion than the first surface region is from the first protrusion, wherein the first surface region, the second surface region and the first side surface constitute the rough region, and wherein the first surface region has a surface roughness whose Ra value falls within a range of 2.5-2.9 μm, the second surface region having a surface roughness whose Ra value falls within a range of 1.5-1.9 μm, the first side surface having a surface roughness whose Ra value falls within a range of 2.5-2.9 μm, where each of the Ra values is defined in conformance with JIS B 0601:2013 standard.

17. A method of manufacturing the fixing device according to claim 1, the method comprising polishing the first distal end surface by a polishing member having a polishing surface such that the first distal end surface has a surface roughness lower than a surface roughness of the rough region.

18. A method of manufacturing the fixing device according to claim 1, the method comprising:

molding the first distal end surface of the first protrusion with a first mold surface formed in a mold; and molding at least one of the first side surface of the first protrusion and the surface of the base part with a second mold surface formed in the mold, the second mold surface having a surface roughness higher than a surface roughness of the first mold surface.

19. A fixing device comprising:

a belt having a surface;

a belt guide configured to guide movement of the belt, the belt guide comprising:

a base part having a surface;

a first protrusion protruding from the surface of the base part toward the surface of the belt, the first protrusion having a first distal end surface and a first side surface, the surface of the belt being configured to contact the first distal end surface, the first distal end surface having a first distal surface roughness, the first side surface connecting the first distal end surface and the surface of the base part, the first side surface including a rough region having a surface roughness higher than the first distal surface roughness; and a drive roller configured to move the belt in a moving direction, the belt and the drive roller being configured to provide a nip region therebetween for nipping a sheet therebetween to convey the sheet, wherein the rough region comprising a first rough region and a second rough region, the second rough region being arranged closer to the nip region than the first rough region is to the nip region in the moving direction of the belt, the second rough region having a surface roughness higher than a surface roughness of the first rough region.

20. The fixing device according to claim 19, wherein the belt guide further comprises a second protrusion protruding from the surface of the base part toward the surface of the belt, the second protrusion being positioned spaced away from the first protrusion, the second protrusion having a second distal end surface and a second side surface, the surface of the belt being configured to contact the second distal end surface, the second side surface connecting the second distal end surface and the surface of the base part, wherein the surface of the base part includes a connecting area connecting the first protrusion and the second protrusion, wherein at least one of the first side surface, the second side surface, and the connecting area includes the rough region, and wherein the connecting area includes the rough region, the rough region comprising a first rough region and a second rough region, the second rough region being arranged closer to the nip region than the first rough region is to the nip region in the moving direction of the belt, the second rough region having a surface roughness higher than a surface roughness of the first rough region.

21. A fixing device comprising:

a belt having a surface;

a belt guide configured to guide movement of the belt, the belt guide comprising:

a base part having a surface, the surface of the base part including:

a first surface region including a bordering area; and a second surface region;

a first protrusion protruding from the surface of the base part toward the surface of the belt and bordering the bordering area of the first surface region of the base part, the first protrusion having a first distal end surface and a first side surface, the surface of the belt being configured to contact the first distal end surface, the first distal end surface having a first distal surface roughness, the first side surface connecting the first distal end surface and the surface of the base part, the first surface region, the second surface region and the first side surface constituting a rough region having a surface roughness higher than the first distal surface roughness, wherein the second surface region is located farther away from the first protrusion than the first surface region is from the first protrusion, and wherein the first surface region has a surface roughness whose Ra value falls within a range of 3.0-3.5 μm, the second surface region having a surface roughness whose Ra value falls within a range of 2.0-2.4 μm, the first side surface having a surface roughness whose Ra value falls within a range of 3.0-3.5 μm, where each of the Ra values is defined in conformance with JIS B 0601:2013 standard.

22. The fixing device according to claim 21, wherein the first surface region has a surface roughness whose Ra value falls within a range of 2.5-2.9 μm, the second surface region having a surface rough ness whose Ra value falls within a range of 1.5-1.9 μm, the first side surface having a surface roughness whose Ra value falls within a range of 2.5-2.9 μm, where each of the Ra values is defined in conformance with JIS B 0601:2013 standard.

* * * * *